US012648604B2

(12) United States Patent
Perkonigg et al.

(10) Patent No.: US 12,648,604 B2
(45) Date of Patent: Jun. 9, 2026

(54) SURGICAL GOWN, SURGICAL GOWN KIT, AND METHOD FOR APPLYING A SURGICAL GOWN

(71) Applicant: Lohmann & Rauscher GmbH, Vienna (AT)

(72) Inventors: Valerie Perkonigg, Vienna (AT); Manuela Seidl, Pilgersdorf (AT); Erik Steinlechner, Baden (AT); Markus Reiterer, Vienna (AT); Siegfried Schwarz, Vienna (AT)

(73) Assignee: Lohmann & Rauscher GmbH, Vienna (AT)

( * ) Notice: Subject to any disclaimer, the term of this patent is extended or adjusted under 35 U.S.C. 154(b) by 102 days.

(21) Appl. No.: 18/580,094

(22) PCT Filed: Jul. 27, 2022

(86) PCT No.: PCT/EP2022/071049

§ 371 (c)(1),
(2) Date: Jan. 17, 2024

(87) PCT Pub. No.: WO2023/006807

PCT Pub. Date: Feb. 2, 2023

(65) Prior Publication Data

US 2024/0334992 A1 Oct. 10, 2024

(30) Foreign Application Priority Data

Jul. 28, 2021 (DE) ..... 10 2021 119 558.6

(51) Int. Cl.
*A41D 13/12* (2006.01)

(52) U.S. Cl.
CPC .... *A41D 13/1209* (2013.01); *A41D 2300/324* (2013.01); *A41D 2300/328* (2013.01)

(58) Field of Classification Search
CPC .... A41D 13/1209; A41D 13/12; A41D 13/00; A41D 13/129; A41D 2400/44
See application file for complete search history.

(56) References Cited

U.S. PATENT DOCUMENTS 4,290,148 A * 9/1981 Roberts ..... A41D 13/1209 2/913
4,674,132 A 6/1987 Stein et al.
5,140,708 A 8/1992 Burns

FOREIGN PATENT DOCUMENTS

DE 2549163 A1 5/1976
DE 102009024999 A1 12/2010
(Continued)

OTHER PUBLICATIONS

Translation of International Search Report mailed Nov. 9, 2022 for International Application No. PCT/EP2022/071049, 2 pages.

*Primary Examiner* — Uyen T Nguyen
(74) *Attorney, Agent, or Firm* — Schwabe, Williamson & Wyatt, P.C.

(57) ABSTRACT

Surgical gown comprising a material web (10), wherein a donning aid (30) is provided, the surgical gown having a first fastening means (52) for detachably fastening the material web (10) to a suspension (100) for the surgical gown on a first boundary surface (10*a*) of the material web (10) in the region of an upper edge (16) and/or in the region of the upper end of a lateral edge (14) of the material web (10), and an inner binding tape (80) being attached to a boundary surface (10*b*) of the material web (10) which faces the wearer when the surgical gown is donned.

13 Claims, 5 Drawing Sheets

(56) References Cited

FOREIGN PATENT DOCUMENTS

| | | | |
|---|---|---|---|
| DE | 102018113366 | A1 | 12/2019 |
| WO | WO2013184275 | A1 | 12/2013 |

* cited by examiner

Transfer card fastened to binding tape (tube)

SURGICAL GOWN, SURGICAL GOWN KIT, AND METHOD FOR APPLYING A SURGICAL GOWN

CROSS REFERENCE TO RELATED APPLICATION

The present application is a 35 U.S.C. § 371 national phase entry application of, and claims priority to, International Patent Application No. PCT/EP2022/071049 filed Jul. 27, 2022, which claims priority to German Patent Application No. DE 10 2021 119 558.6 filed Jul. 28, 2021, the disclosures of which are hereby incorporated by reference in their entirety for all purposes.

BACKGROUND

When putting on a surgical gown, relevant hygiene regulations must be observed. There are situations and environments in which an assistant (i.e., another person in addition to the wearer) is available to put on the gown and situations and environments in which this is not the case. Typically, a given surgical gown is used in the same situation or environment for which the gown is specifically adapted. This makes it easier for medical staff to identify the correct handling of the gown, especially in medically critical moments. This also means that the staff does not have to reposition itself when handling the gown and adapt the situation or environment to the gown. However, this also means that different surgical gowns are used in situations and environments where an assistant is available to put on the gown than in situations and environments where this is not the case.

BRIEF DESCRIPTION OF THE DRAWINGS

Embodiments are explained below with reference to the drawings. Shown in the drawing are FIG. 1 a schematic view of a side of a surgical gown facing the wearer in the state of use according to a first embodiment, FIG. 2 a schematic view of an outside of the surgical gown according to FIG. 1 facing away from the wearer when put on, FIG. 3 a schematic view of a side of a surgical gown facing the wearer in the state of use, FIG. 4 a schematic view of a side of a surgical gown facing away from the wearer in the state of use according to FIG. 3, FIG. 5 a fastening arrangement of a surgical gown, FIG. 5A a detailed illustration to illustrate the detachable attachment of a transfer card to the left binding tape of a surgical gown.

Components that are shown in several figures have the same reference symbols.

DETAILED DESCRIPTION

Figure 1:
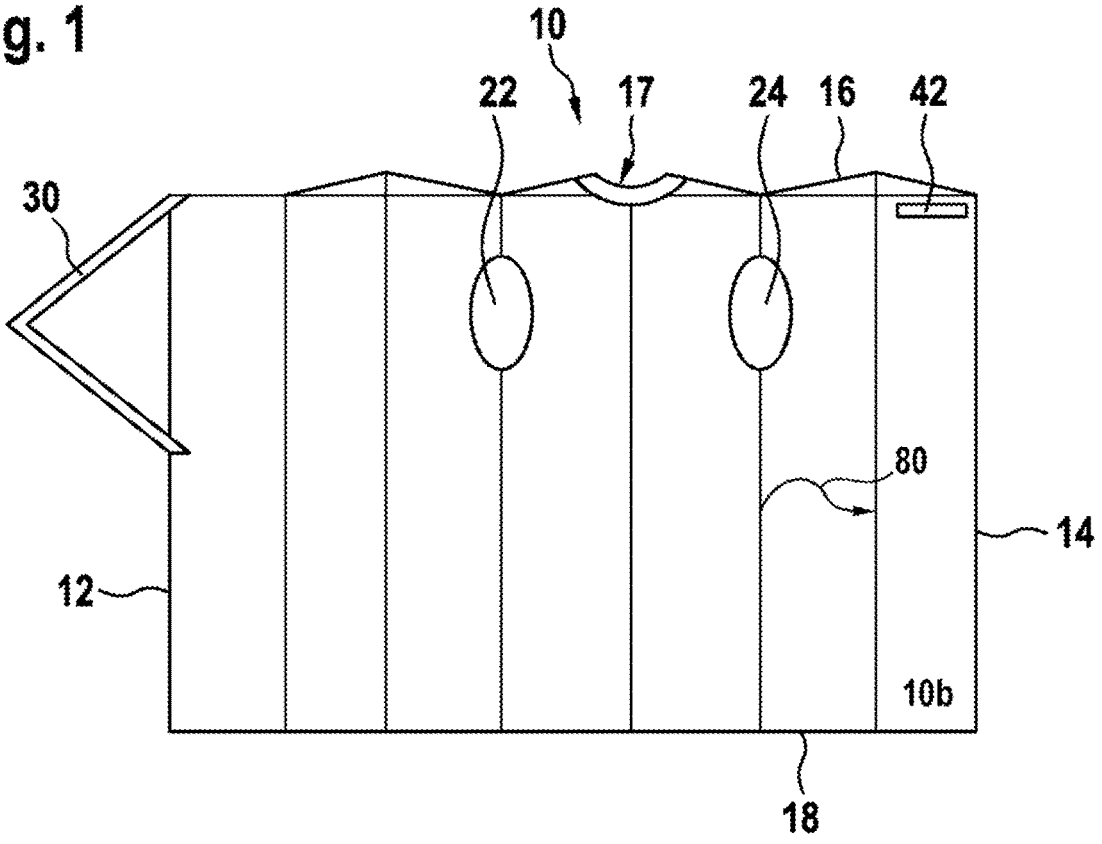

Embodiments relate to a surgical gown with a first lateral edge which may run approximately in a straight line and a second lateral edge which may run approximately parallel to the first lateral edge, an upper edge which connects the lateral edges to one another and an upper edge which connects the lateral edges to one another lower edge delimited material web, a first sleeve extending from a first opening in the material web and attached to the material web, a second sleeve extending from a second opening in the material web and attached to the material web, wherein the first opening is arranged between the first lateral edge and the second opening and the openings are arranged closer to the upper edge than to the lower edge, at least in the area of the upper half of the first lateral edge adjacent to the upper edge, a dressing aid forming an extension of the material web is provided, wherein the surgical gown has a first fastening means for producing a releasable attachment of the material web to a suspension for the surgical gown on a boundary surface of the material web, in particular the outer boundary surface facing away from the wearer when being worn, in the region of the upper edge and/or in the region of the upper end of the second lateral edge, and wherein an inner binding tape is attached to a second boundary surface of the material web facing the wearer when the surgical gown is being worn. The "wearer" for the purpose of embodiments herein is the person who is to put on the surgical gown or on whom the surgical gown is to be placed. Embodiments further relate to a kit with the surgical gown according to the invention contained in a package and two methods for putting on the surgical gown.

Embodiments are related to providing a surgical gown that can be put on flexibly in various situations and environments without violating relevant hygiene regulations, i.e. without endangering the sterility of the gown, and in particular can be put on both with and without the support of an assistant, such as in emergency situations, under time pressure or when there is temporarily only one person in the operating room.

In embodiments, this object is achieved by a further development of the known surgical gowns, which is initially characterized in that, at least in the area of the upper half of the first lateral edge adjacent to the upper edge, a dressing aid which forms an extension of the material web is provided. This dressing aid has a dual function in a further development, as will be explained below.

Furthermore, the further development is characterized in that the surgical gown has a first fastening means for producing a releasable attachment of the material web to a suspension for the surgical gown on a first boundary surface (e.g. outside) of the material web in the area of the upper edge and/or in the area of the upper end of the second lateral edge. The dressing aid and the first fastening means enable the wearer to put on the surgical gown in a particularly advantageous manner in accordance with hygiene regulations without the support of an assistant, i.e. the wearer puts on the surgical gown independently.

In addition, the further development is characterized in that an inner binding tape is attached to a second boundary surface (e.g. inside) of the material web that faces the wearer when the surgical gown is on. The inner binding tape and the dressing aid enable this surgical gown to be put on in a particularly advantageous manner in accordance with hygiene regulations, even in cases where a supporting assistant is available. In other words, the surgical gown in embodiments herein is designed, due to the dressing aid, the first fastening means and the inner binding tape, to be put on independently by the wearer in accordance with hygiene regulations without the assistance of an assistant, or alternatively without fastening the surgical gown to the suspension but rather to be put on the wearer with the support of an assistant. The surgical gown in embodiments herein thus provides a dual use option and can therefore be used in different situations and environments and is thus more flexible overall.

The inner binding tape can be fastened to the second boundary surface (e.g., the inside) of the material web at waist level of the wearer, for example below the second opening and at approximately the same distance from the second edge as the center of the second opening. The inner binding tape is designed to be attached to the donning aid for closing the surgical gown, in particular on the back of the wearer, with the inner binding tape and the dressing aid being knotted for this purpose. The length and/or position of the inner binding tape on the second boundary surface (e.g. inside) of the material web may be chosen such that both sterility and overlapping can be guaranteed when putting it on, in particular that the gown can be tied together and the area of the material web adjacent to the second lateral edge (right material web) does not reach the non-sterile area (e.g. due to pre-folding). Furthermore, the length and/or position of the inner binding tape are selected such that the inner tie band does not inhibit dressing without a second person. The inner binding tape can be attached to the material web 50 to 200 millimeters, 75 to 125 millimeters, or 100 millimeters below the second opening and have a length of 200 to 400 millimeters, 250 to 350 millimeters, or 300 millimeters or more. The length of at least 300 millimeters is particularly advantageous, as this length allows sufficient tape to be available for reliable binding for different sized wearers. The specification of 100 millimeters is particularly advantageous in order to be as far as possible towards the upper end of the material panel without being covered by the sleeve opening.

In embodiments, among other things, a possibly asymmetrical extension of a surgical gown is provided, which enables the wearer to wrap or twist himself into the gown starting from a lateral edge equipped with the dressing aid, so that after wrapping or twisting an overlap area of the gown lateral edges forms, in which the lateral edges can be attached to one another without the intervention of an assistant.

For this purpose, the wearer can grasp the donning aid with one hand in such a way that he stands with his back to the material web, then turns around his own axis in such a way that he puts his free hand into the opening of the material web adjacent to the dressing aid and the sleeve attached to it, continues to rotate around his own body axis while maintaining the direction of rotation, and then inserts the hand that is holding the dressing aid into the other opening and the sleeve attached to it. If necessary, the wearer can insert the dressing aid into the sleeve and leave it there.

It has been shown that putting on a surgical gown as described is significantly easier for the user than putting on a surgical gown of the type described, for example, in WO 2013/184275 A1, which is done by simultaneously inserting both arms into the sleeves without twisting.

As an alternative to this method for putting on the surgical gown, which is supported by the suspension, in which the wearer puts on the surgical gown independently, the surgical gown can, if an assistant is available, also be put on according to another method, in which the surgical gown removed from its packaging is carried by the wearer with his chest facing the material web and with each hand in one of the sleeves, the dressing aid is knotted with the inner binding tape by the assistant, and a first adhesive strip is connected by the other person to a second adhesive strip (see below), so that the surgical gown is closed by the other person on a first side of the wearer, on the back of the wearer.

The dressing aid is used in both procedures to put on the surgical gown. In one embodiment, the dressing aid can be formed in that a first distance between the first opening and the first lateral edge is greater than a second distance between the second opening and the second lateral edge.

The distance between the opening and the lateral edge is understood as the distance between the boundary line or edge of the opening facing the corresponding lateral edge and the lateral edge along a straight line connecting the centers of the openings in the material web and generally running perpendicular to the lateral edges.

To provide a sufficiently wide overlap area, the ratio between the first distance and the second distance may be 1.2 or greater, in particular 1.4 or greater. To avoid excessive material consumption, the ratio between the first distance and the second distance is expediently chosen so that it is less than 2.

An overlap of the first edge and the second edge can be ensured without taking into account the dimensions of the openings to which the sleeves are attached if the ratio between the first distance and the distance between the openings is greater than 1.2, and may be greater than 1.4. In order to avoid excessive material consumption, the ratio between the first distance and the distance between the openings is expediently chosen so that it is less than 4, in particular less than 3. The distance between the edges of the openings facing each other is referred to as the distance between the openings.

A secure closure of the surgical gown after putting it on, i.e. after wrapping it or twisting therein, can be achieved if a first adhesive strip is arranged on a first boundary surface of the material web facing away from the wearer between the first lateral edge and the first opening and in the area of a second boundary surface of the material web opposite the first boundary surface, which faces the wearer when dressed, a second adhesive strip is arranged in the region of the second lateral edge, the adhesive strips coming into overlapping, adhesive contact with one another at least in sections when the surgical gown is put on. The first adhesive strip can form an angle of 30° to 150°, and may be approximately 90°, with the second adhesive strip and one of the adhesive strips may run approximately parallel to the corresponding lateral edge of the material web. By appropriately aligning the adhesive strips which come into adhesive contact with one another when a surgical gown according to embodiments herein is put on, it is achieved that no precise positioning of the adhesive strips relative to one another is required in order to ensure that the adhesive strips adhere to one another. In this context, it has proven to be particularly useful if the adhesive strips run perpendicular to one another and/or each have a length of 10 cm or more, and may be 20 cm or more.

In order to provide a particularly large adhesive surface or particularly good adhesion, it has proven to be expedient if the adhesive strips cross each other when the surgical gown is in place so that they enclose two acute angles of approximately 20° to 80° with one another. For this purpose, both adhesive strips can be arranged in the area of the upper edge of the material web in such a way that they enclose a corresponding acute angle with the side or upper edge of the material web. The side edge, top edge and adhesive strip then form a rectangular triangle in which the right angle is formed between the lateral edge and top edge and the acute angles determine the crossing angle of the adhesive strips.

The adhesive strips of surgical gowns according to embodiments herein can be designed as hook and eye tapes of a surface fastener (Velcro), as double-sided adhesive tape, as combinations thereof or the like.

In one embodiment, the adhesive strips are arranged in the area of the upper edge of the material web, so that the adhesive strips adhere to one another in the shoulder area, upper back area or shoulder girdle of the wearer.

With a view to making it easier to put on a surgical gown according to embodiments herein without an assistant, it has proven to be particularly useful if, in addition to or as an alternative to the described asymmetric widening of the material web, in the area of the upper half, i.e., the half facing the upper edge of the material web, or in the shoulder area, upper back area or shoulder girdle of the wearer of the first lateral edge, a further dressing aid is provided which forms an extension of the material web. To put on the surgical gown, the wearer can grasp and spread the material web in the area of this additional dressing aid, so that at least the upper edge of the material web, usually the entire material web, is unfolded. Then the wearer, who holds the additional dressing aid with one hand and, if necessary, stands with his back to the material web, can turn into the spread out material web and insert the other hand into the first opening of the material web and the sleeve attached to it. In the further course, the wearer can twist further into the material web, insert the hand holding the further dressing aid, if necessary together with the further dressing aid, into the sleeve attached to the second opening and complete the application, whereby the adhesive strips can automatically come into adhesive contact with one another.

In one embodiment, the dressing aid has a tape fixed to the material web in the area of the upper end of the first lateral edge, i.e., the end of the first lateral edge facing the upper edge, at its end facing away from the upper end of the material web, can be attached to the material web in the middle area of the first lateral edge. The dressing aid, designed as a tape, and may be attached to the surgical gown in the shoulder area and at hip height. When attaching the band-shaped dressing aid, it is advisable to ensure that it is attached in such a way that the pulling force on the shoulder and hip is similar.

Within the scope of embodiments herein, the possibility was also considered of implementing a dressing aid, optionally in addition to an asymmetrical widening of the material web, over the entire surface and integrating it into the material web. It is also conceivable to design the dressing aid with a grip for the fingers (which is temporarily clamped between the fingers) and/or to equip it with an opening in the material web, into which a finger can be inserted to make it easier to slip out. The dressing aid can also be designed in such a way that it is inserted into the corresponding sleeve together with the hand holding the dressing aid and remains there.

To put on the surgical gown, it is usually in advance removed from packaging in which it is sterile-packed. Care must be taken to ensure that the gown does not fall out of the packaging onto the floor. In order to comply with the hygiene regulations when putting on the surgical gown independently, it can be provided that the surgical gown is removably fastened at least at shoulder height, and may be at least at head or eye level or above the head, on a suspension on a wall or a fixed part of the building or object, such as such as a shelf or cupboard.

In view of hygiene requirements, a surgical gown according to embodiments herein expediently has in the area of the upper edge and/or in the area of the upper end of the second lateral edge, i.e. the end of the second lateral edge facing the upper edge, a first means of fastening to the material web for producing a detachable fastening to a suspension for the surgical gown. When the surgical gown is spread out with the help of the dressing aid, the first fastening means can ensure that the surgical gown is held on the suspension fixed to a wall at shoulder height until the wearer has completely twisted into the surgical gown. The connection between the suspension and the first fastening means of the surgical gown can then be released and donning can be completed. The adhesive connection between the crossing adhesive strips of the surgical gown is expediently established before the detachable connection between the first fastening means and the suspension is released.

If the surgical gown has a tube (which may be elastic) of a fastening arrangement on one of the binding tapes to protect against contamination, which is expediently equipped with a snap fastener for releasably fastening to the material web, to complete the donning of the surgical gown the material web must be loosened in order to remove the binding tape from the tube and close the surgical gown. The tube can protect the binding tape (left binding tape) attached in the area of the second lateral edge, while the right binding tape is sterile in the packaging due to its covering by the sheath and is protected from contamination when unpacking and putting on the gown due to the loose sagging.

As can be seen from the above explanation, the tape of the fastening arrangement can have a second fastening means, such as a snap fastener, designed for releasably fastening the tape to the region of the upper edge of the material web, while the material web can be provided with a counterpart in the region of its upper edge, formed as first fastening means, such as a complementary snap fastener. The first and second fastening means together can also form a predetermined breaking point, e.g. in the form of a perforation and/or a suitably designed weld seam, at which the two fasteners can be separated from each other by tearing. In this case, the two fastening means are not snap fasteners, but rather pieces of material, such as tape sections, which are releasably attached to one another at the perforation or predetermined breaking point until they tear. In any case, the tape between the tube and the second fastening means can be at least partially formed from an elastic material.

The tape with second fastening means can extend from the tube on the side of the tube facing away from the suspension and can be releasably attached to the material web.

After separating the fasteners attached to the tape on the one hand and in the area of the upper edge of the material web on the other hand, the material web can be detached from the tape in order to eliminate the attachment of the surgical gown to the suspension in such a way that the wearer can easily remove the surgical gown from the suspension and start working.

When the gown is put on, the left binding tape of the surgical gown can be released, for example by simply pulling on it, from a transfer card which is attached to the tube and in which the left binding tape is clamped or knotted (e.g. by means of a loop on the left binding tape). The pull releases the clamping action of the card or knot and releases the left binding tape from the tube. In this disclosure, the "transfer card" can generally be an attachment card or a clamp card. The transfer card may be made of cardboard.

However, the transfer card is optional, so that when the gown is put on, the left tie of the surgical gown can alternatively be released by simply pulling on it from a releasable knot attached to the tube and in which the left binding tape is knotted. The pull loosens the detachable knot and releases the left binding tape from the tube. In any case, the tension can be applied by the wearer moving away from the suspension.

The transfer card then falls to the floor or remains on the tube or can be placed in the packaging while the left binding tape can be used to close the gown.

The transfer card can therefore have means for releasably and non-positively securing the left binding tape to the transfer card. These means can be implemented in the form of a slot passing through the transfer card, where the left binding tape is clamped. The left binding tape can pass through the slot starting from an entry side, form a loop on the side of the transfer card facing away from the entry side and pass through the slot again in order to get back to the entry side. The loop is then arranged on the side of the transfer card facing away from the entry side. By pulling on the left binding tape, the loop is guided through the slot until the binding tape is completely arranged on the entry side. This will break the connection to the transfer card. The transfer card falls to the floor. To facilitate the introduction of the loop into the slot, the slot passing through the transfer card can open at one end into an insertion opening passing through the transfer card. The transfer card can then be attached to the left binding tape or the tube by first making a loop of the binder tape. The apex of the loop is guided through the insertion opening and then the binding tape is inserted laterally into the slot in such a way that the loop is arranged on the side of the transfer card facing away from the insertion side.

To avoid damage and/or to ensure the required sterility, the surgical gown has the tube releasably attached to its left binding tape, which is attached to the material web, in particular to the second edge, with a second fixed end and has a first loose end into which the left binding tape is pushed with the loose end first, so that the tube surrounds at least part of the length of the left binding tape and the loose end and thereby protects it. The tube has its second end facing the fixed end of the left binding tape and the first end of the tube facing the third fastener or suspension and is loose. The tube further has the second fastening means, which can be releasably connected to the first fastening means of the surgical gown, wherein the second fastening means may be detached from the first fastening means by activating the first and/or third fastening means. As described, the first and second fastening means together can also form a predetermined breaking point, for example in the form of a weld seam and/or perforation, at which the two fastening means can be separated from one another by tearing. In this case the two fastening means are not snap fasteners, but rather pieces of material, such as tape sections attached releasably to one another until tearing occurs. The term "activation" therefore includes pressing, pulling and/or tearing.

When the surgical gown is put on, the left binding tape can be released from the transfer card or knot arranged on the tube, for example by simply pulling on the left binding tape, if this has a clamping effect that can be released by pulling or a knot on the binding tape that can be released by pulling is attached. The transfer card then remains on or falls away from the tube while the left binding tape can be used to close the jacket.

To avoid damage and to ensure the required sterility, the elastic tape, which extends between the suspension and the material web while the gown is being put on, can be accommodated at least in sections within the protective tube made of a textile material. The tube can be equipped with openings for the elastic tape to pass through.

The suspension can be fixed to a wall or another fixed part of the building or an object.

As can be seen from the above explanation of surgical gowns according to embodiments herein, a kit according to embodiments herein has a surgical gown according to the embodiments herein contained in a packaging The packaging of a kit according to embodiments herein can be made of cardboard, plastic, composite materials or the like. It can contain a deep-drawn film or an injection-molded workpiece. The packaging can be designed as a peel flap bag or as a thermoformed plastic package with a film cover that can be peeled off.

In order to ensure trouble-free removal of the surgical gown from the packaging, it has proven to be particularly advantageous if the surgical gown or the material web in the packaging is folded once, and may be several times, like a fanfold or accordion. For this purpose, the material web may be spread out, with the sleeves being placed downwards or towards the lower edge of the material web on the outer boundary surface of the material web facing away from the wearer in the state of use. The material web can then be folded like a fan, starting from the lateral edges in the direction of the openings to which the sleeves are attached. The material web can be folded starting from the first lateral edge in a double accordion fold towards the first opening, while the material web is folded starting from the second lateral edge in a single accordion fold towards the opening.

Subsequently, the material web folded in this way in preparation can be folded like an fanfold, starting from the lower edge towards the upper edge. The folding can take place along fold lines running approximately parallel to the lower edge, while the folding effected in the first step can take place along fold lines running parallel to the lateral edges. In the second step, the folding is expediently effected in such a way that the intermediate product subsequently obtained has a length in a direction parallel to the lateral edges which approximately corresponds to the corresponding dimensions of the packaging.

Finally, the intermediate product thus obtained by double folding can be folded in a fanfold manner starting from the first lateral edge in the direction of the second lateral edge in such a way that the dimensions in a direction perpendicular to the lateral edges correspond approximately to the corresponding packaging dimensions.

Overall, the folding of the material web may be effected in such a way that the outer sides of the folded material web are formed by areas of the inner boundary surface of the material web that faces the wearer in the state of use.

To unfold the material web through the packaging opening, it can be grasped on the dressing aid or material web. The last fanfold fold can then be unfolded in accordance with fold lines running parallel to the lateral edges. The jacket then unfolds downwards in the direction of gravity so that the distance between the upper edge and the lower edge is created. The fanfold obtained in the first folding step is then unfolded until the material web is completely spread out. Overall, the unfolding can thus be integrated into the dressing process.

As can be seen from the above explanation of surgical gowns according to embodiments herein, a first method according to embodiments herein for putting on such a surgical gown may be characterized in that the surgical gown removed from its packaging is releasably attached to the suspension for the surgical gown by means of the first fastening means and is held with one hand on the dressing aid by the wearer with his back or side to the material web, the wearer then rotates around his own axis and, in the course of the rotation, first places the other hand in the opening adjacent to the dressing aid and inserts the material web and the sleeve attached to it and after a further or continued rotation in the same direction of rotation, inserts the hand holding the dressing aid, and in some embodiments together with the dressing aid, into the other opening of the material web and the sleeve attached to it.

In some embodiments, in the first method, the wearer can exert a pull on the attachment of the first fastening means to the suspension by a rotational movement about his own axis in a constant direction of rotation, so that the attachment of the material web to the suspension is released and may be by a further or continued rotation in the same direction of rotation exerts a further pull, for example on the fastening arrangement or the left binding tape on the tube, so that the left binding tape is released from the tube and is connected to the right binding tape for closing of the surgical gown by the wearer.

As can be seen from the above explanation of surgical gowns according to embodiments herein, a second, alternative method according to embodiments herein for putting on such a surgical gown may be characterized by the fact that the surgical gown removed from its packaging is positioned by the wearer with the chest facing the material web and is carried with each hand in one of the sleeves, the dressing aid is connected to the inner binding tape by another person, and in some embodiments the first adhesive strip is connected to the second adhesive strip by the other person, so that the surgical gown on a first side of the wearer, and may be on the back of the wearer, is closed by the other person.

In some embodiments, as part of the second method, the wearer can rotate around his own axis after closing the surgical gown on the first side, and in some embodiments after releasing the second fastening means of the tube from the first fastening means of the material web, while the other person holds the first end of the tube in their hand, so that the first end of the left binding tape is removed from the tube due to a pull from the left binding tape on the tube, the wearer then closing the surgical gown on another side of the wearer, and in some embodiments on the front, by attaching the left binding tape to the right binding tape.

In one embodiment, the material web can be formed from a so-called SMMS (spunbond-meltblown-meltblown-spunbond) material. The material consists of four layers, each of which may be made of thermally bonded polypropylene. The "spunbond" layers have the appearance of a textile product and give the material web wearing comfort, which is required during long operations. In addition, the material can be treated hydrophobically to ensure sufficient protection against liquids such as blood. The main function of the "meltblown" layer is a filtering function. It protects the wearer from bacteria and small particles. The fine structure of these layers allows air exchange and moisture transfer towards the "spunbond" layers.

In another embodiment, the material web consists of consolidated wood pulp and a polyester fleece that is consolidated by means of water jets. The main advantage of this material is the fact that it is very soft and offers a wearing comfort comparable to that of reusable materials, which are often woven fabrics. The barrier effect of this material is limited and lower than that of SMMS, due to the natural structure and the consolidation process. Depending on the operation and the amount of fluid that may be expected, additional material may be used as reinforcement to provide better protection. This can be a polypropylene [PP] nonwoven fabric laminated to a breathable PE [polyethylene] film.

According to a further embodiment, for which independent protection is being sought, at least one tape of the fastening arrangement, which can be releasably connected to the first fastening means of the surgical gown, is also connected via the tube at least partially accommodating this binding tape, likewise at least partially releasably accommodated in the tube. The tape of the fastening arrangement can be pulled out of the tube independently of the binding tape. The binding tape can form an extension of the at least one tape of the fastening arrangement, the tape arrangement thus obtained being able to be gradually changed in terms of the available length in the course of the process of putting on the surgical gown by releasing the second fastening means from the first fastening means to provide a tape arrangement of greater length, while subsequently the at least one tape of the fastening arrangement and the binding tape can be removed from the tube independently of one another.

If this brief description describes features that are not listed in the patent claims, these features can be combined with any of the patent claims and can also be combined with each other in any way.

One embodiment shown as an example in the drawings relates to a surgical gown with a first lateral edge 12 which may run approximately in a straight line and a second lateral edge 14 which may extend approximately parallel to the first lateral edge, an upper edge 16 which connects the lateral edges to one another and a lower edge 18 delimited by a material web 10, a first sleeve (not shown in the drawings) extending from a first opening 22 in the material web 10 and attached to the material web 10, a second sleeve (not shown in the drawings) extending from a second opening 24 in the material web 10 and attached to the material web 10, wherein the first opening 22 is arranged between the first lateral edge 12 and the second opening 24 and in some embodiments the openings 22, 24 are arranged closer to the upper edge 16 than to the lower edge 18, wherein at least in the area of the upper half of the first lateral edge 12 adjacent to the upper edge 16, a donning aid 30 forming an extension of the material web 10 is provided, wherein the surgical gown has a first fastening means 52 for producing a releasable attachment of the material web 10 to a suspension 100 for a surgical gown on a first boundary surface 10*a* of the material web 10, in particular the outer boundary surface 10*a* in the region of the upper edge 16 and/or in the region of the upper end of the second lateral edge 14, and wherein an inner binding tape 80 is attached to a second boundary surface 10*b* of the material web 1 facing the wearer when the surgical gown is being worn.

The surgical gown according to embodiments herein can be designed asymmetrically in such a way that the distance between the first opening 22 and the first lateral edge 12 is greater than the distance between the second opening 24 and the second lateral edge 14. The distance between the second opening 24 and the second lateral edge 14 herein corresponds approximately to the distance between the openings 22 and 24, i.e. the distance between the mutually facing edges of the openings 22 and 24.

In the area of the first lateral edge 12, a ribbon-shaped dressing aid 30, shown here as an example in a triangular shape, is attached, which is arranged on the one hand at the upper end of the first lateral edge 12 approximately at shoulder height and on the other hand in the middle area of the first lateral edge, i.e. approximately at waist height of the wearer.

To a second boundary surface 10*b* of the material web 10 that faces the wearer when the surgical gown is on, an inner binding tape 80 is attached, which, together with the dressing aid 30, can be used for closing of the surgical gown by an assistant.

Figure 2:
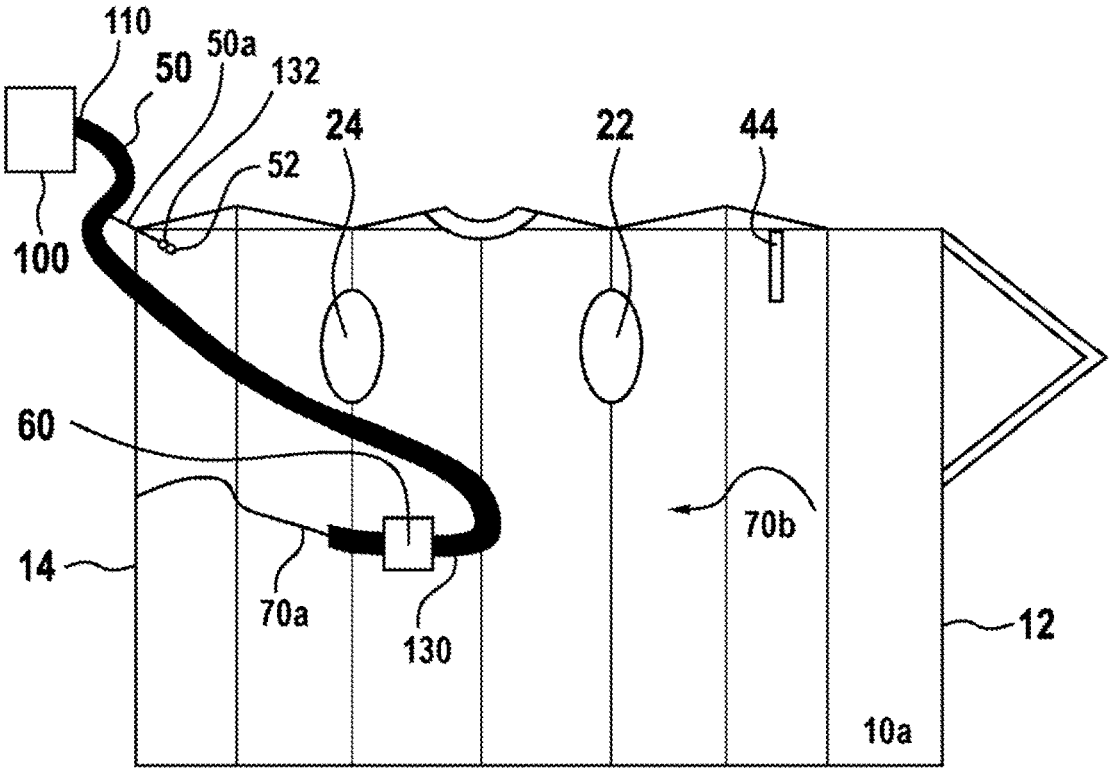
Figure 4:
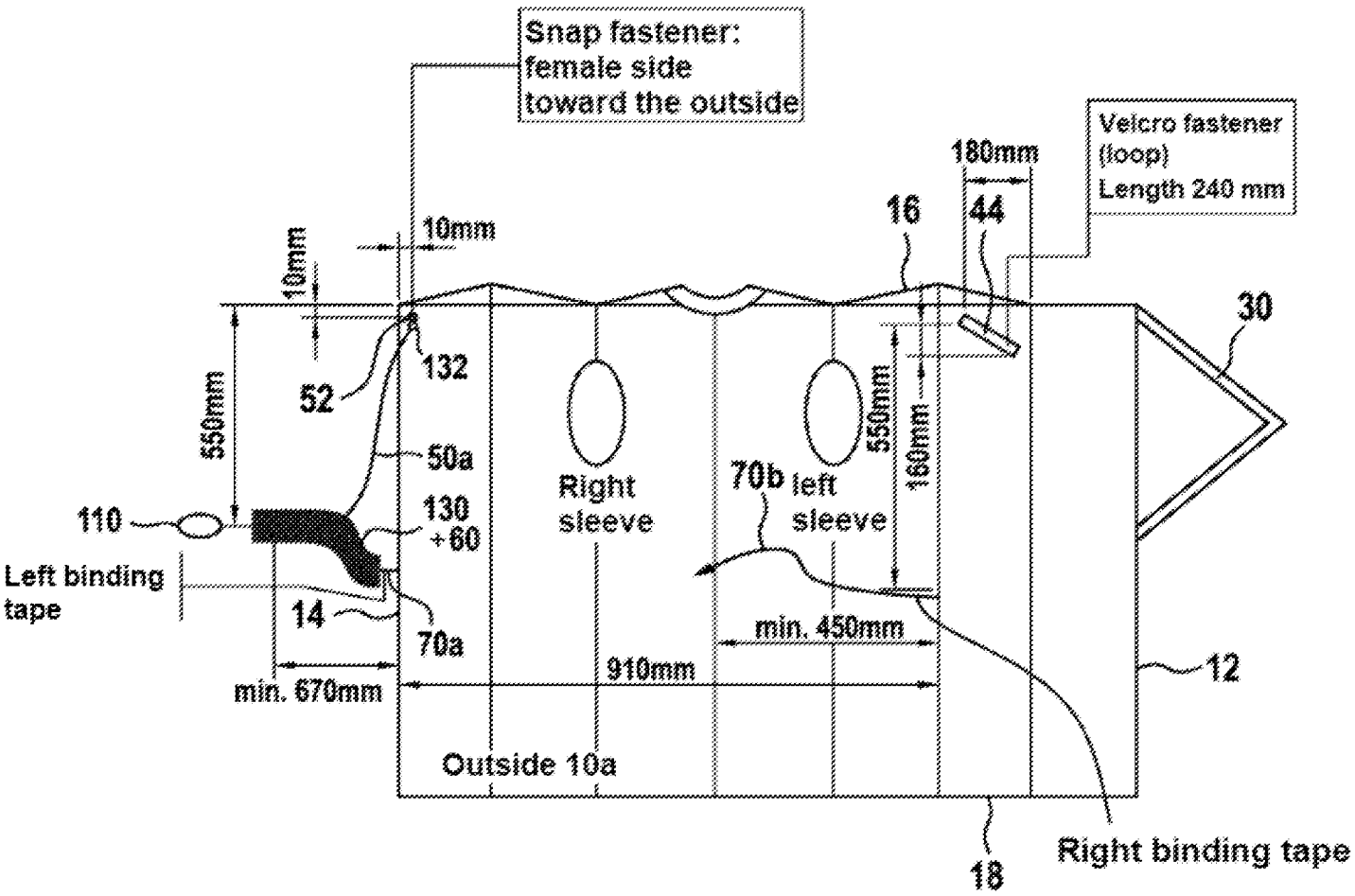

As can be seen in FIG. 2, in the area of the upper end of the second lateral edge 14 the material web 10 is equipped with a fastening arrangement 50 with which the material web 10 is releasably attached to a suspension 100. At a first end of the fastening arrangement 50, shown in more detail in FIG. 5, the at least partially elastic tape 110 (binding tape), having fasting means 126, such as a tube and/or snap fastener is located, with which the fastening arrangement 50 is releasably fastened to the suspension 100. The fastening arrangement 50 of the embodiment shown in the drawing also has an elastic band 50*a* at 50*a*, at the end of which a second fastening means 132 (e.g. a predetermined separation line, surface fastener) and/or a snap fastener 132 is provided, which is also shown in more detail in FIG. 5, and as shown in FIG. 4, can be releasably attached with the first fastening means 52. The second fastening means 52 can be attached to the first boundary surface 10*a* or to the second boundary surface 10*b* of the material web 10. At a second end of the fastening arrangement 50, the fastening arrangement 50 receives the first end of the left binding tape 70*a* to releasably connect it to the attachment assembly 50, which further includes a tube 130 and a transfer card 60 attached to the tube or a releasable knot attached to the tube 60. The one or more tapes 50*a*, 110 may be fixed onto the tube.

In some embodiments, the tapes 50*a* and 110 are both realized together by one and the same elastic tape (e.g. a binding tape), so that 50*a* and 110 form two sections of the one elastic tape 50*a*, 110, these two sections being at different ends of the tape 50*a*, 110. Section 110 is located at the first end of the mounting assembly and protrudes from the tube 130. The tape 50*a*, 110 is introduced into the tube 130 through the first end of the tube 130 facing away from the left binding tape 70*a* at reference number 110 in FIG. 5, extends through part of the tube 130, emerges from the tube at an exit point 134 (approximately in the middle of the tube 130) and forms section 50*a* there. At a second end of this elastic tape 50*a*, 110 is located the second fastening means 132 in section 50*a* for releasably fastening to the material web 10 and at the other, first end of this elastic tape 50*a*, 110 is located the third fastening means 126 in section 110, which is designed to releasably attach the band 50*a*, 110 and thus also the tube 130 and the material web 10 to the suspension 100. The third fastening means 126 may comprise a loop and/or a snap fastener. The second fastening means 132 may comprise a loop and/or a snap fastener.

As shown as an example in FIGS. 2, 4 and 5, the arrangement of the fastening arrangement 50 is as follows, starting from the suspension 100. Starting from the suspension 100, the fastening arrangement 50 follows. The fastening arrangement 50 comprises the elastic tape 50*a*, 110, the tube 130 and the transfer card or releasable knot 60. Starting from the suspension 100, there is first the third fastening means 126 of the elastic tape 50*a*, 110 with which the fastening arrangement 50 can be releasably attached to the suspension 100. The third fastening means 126 is located at a first end of the tape 50*a*, 110. The tape 50*a*, 110 is inserted with its second end into the tube 130 at its first end and emerges from the tube 130 at the exit point 134 of a side surface of the tube 130, approximately in the middle of the tube 130, and with its second end, on which the second fastening means 132 is located, can be releasably fastened to the material web 10 with the first fastening means 52. In other words, the fastening arrangement 50 is releasably fastened to the material web 10 by means of the first and second fastening means 52, 132. At the second end of the tube 130, the first (loose) end of the left binding tape 70*a* is inserted into the tube 130 and releasably fastened there with the transfer card 60 or the releasable knot 60. By pulling on the second end or the second fastening means 132 of the tape 50*a*, 110, the tape 50*a*, 110 can be detached from the material web 10. By pulling on the left binding tape 70*a*, the left binding tape can be detached from the transfer card or the releasable knot 60, so that the fastening arrangement 50 is only connected to the suspension 100 and the material web 10 is no longer connected to the fastening arrangement 50 and also no longer to the suspension 100.

As can be seen in FIG. 1, an adhesive strip 42 is arranged at the upper end of the second lateral edge 14, which extends approximately perpendicular to the second lateral edge 14. Between the first lateral edge 12 and the first opening 22, a second adhesive strip 44 is arranged in the area of the upper edge 16, extending approximately parallel to the first lateral edge 12. The adhesive strip 42 attached in the area of the second lateral edge 14 is arranged on the inside of the material web, while the adhesive strip 44 is arranged between the first lateral edge 12 and the first opening 22 on the outside of the material web.

The wearer can completely remove the material web from the packaging, for example with the help of the dressing aid 30, releasably attach the surgical gown to the suspension 100 and fully unfold the surgical gown against the pretensioning force of the band 50*a*, 50 of the fastening arrangement. As a result, the wearer, who is initially standing with his back to the material web, can rotate his body into the material web and insert the hand that is not grasping the dressing aid 30 into the first opening 22 and the sleeve attached thereto. If the wearer turns further, he can insert the hand that is grasping the dressing aid 30 into the second opening 24 and the sleeve attached thereto. In the course of the further inward rotation, the adhesive strip 44 comes into contact with the adhesive strip 42, with adhesive contact of the adhesive strips 42 and 44 being promoted by the crossed arrangement of these adhesive strips. This crossed arrangement helps to ensure an adhesive attachment in the area of the adhesive strips even if the adhesive strips or the material web are not precisely aligned. The wearer can cause a pull on the attachment of the first fastening means 52 to the second fastening means by a rotational movement about his own axis in a constant direction of rotation, so that the first fastening means 52 is released from the second fastening means 132 and in some embodiments by a further or continued rotation in the same direction of rotation induces a further tension, for example from the fastening arrangement 50 or the left binding tape 70*a*, on the tube 130, so that the left binding tape 70*a* is released from the tube 130 and is connected with the right binding tape 70*b* by the wearer to close the surgical gown. The tube with the elastic band 50*a* accommodated therein can continue to remain on the suspension 100 and can only be detached from it during a later clean-up process.

As an alternative to this method for putting on the surgical gown which is supported by the suspension 100, wherein the wearer puts on the surgical gown independently, if an assistant is available the surgical gown can also be put on using another method according to embodiments herein, wherein the surgical gown removed from its packaging is worn by the wearer with his chest facing the material web 10 and with each hand in one of the sleeves, the dressing aid 30 is fastened to the inner binding tape 80 by the assistant, and in some embodiments a first fastener strip 42 is connected by the other person to a second fastener strip 44, so that the surgical gown is closed by the other person at a first side of the wearer, preferably at the back of the wearer. In some embodiments, as part of the second method, the wearer can rotate around his own axis after closing the surgical gown on the first side, and in some embodiments after releasing the second fastening means 132 of the tube 130 from the first fastening means 52 of the material web 10, while the other person holds the first end of the tube 130 in his hand, so that the first end of the left binding tape is removed from the tube due to a pull of the left binding tape 70*a* on the tube 130 by the tube 13 and transfer card or knot 60, and the wearer then holding the surgical gown on another side of the wearer, for example at the front, closing the surgical gown by attaching the left binding tape 70*a* to the right binding tape 70*b*.

The wearing comfort of a surgical gown according embodiments herein may be improved by an indentation 17 in the area of the upper edge 16 of the material web 10, which is arranged between the openings 22 and 24 and forms a collar around the wearer's neck when the surgical gown is put on.

The surgical gown have a tube 130 for protecting the left binding tape 70*a* from contamination, the tube 130 being releasably attachable to the left binding tape 70*a*, and the left binding tape 70*a* being able to be pushed into the tube 130 with the first end first so that the tube 130 surrounds at least part of the length of the left binding tape 70*a*.

The second end of the tube 130 is for receiving the first end of the first binding tape 70*a*, the first end of the tube being loose and/or the tube 130 being part of the fastening arrangement 50 and having a third fastening means 126 at the first end of the tube, which is designed to releasably attach the tube 130 to the suspension 100.

The tube 130 can be equipped with the at least sectionally elastic band 50, the band 50*a* being arranged or fastened at one end to the tube 130, and in the area of its other end having the second fastening means 132 which can be detachably connected to the first fastening means 52. The fastening arrangement 50 at a second end has the third fastening means 126, with which the fastening arrangement 50 can be releasably fastened to the suspension 100.

The left binding tape 70*a* and the tube 13 can be connected to one another by means of a transfer card or knot 60 arranged on the tube in such a way that the left binding tape 70*a* is released from the transfer card or knot 60 by pulling on the left binding tape 70*a*, for example with the pull being applied by another person who is not the wearer of the surgical gown or by way of the suspension 100 or the fastening arrangement 50.

Figure 3:
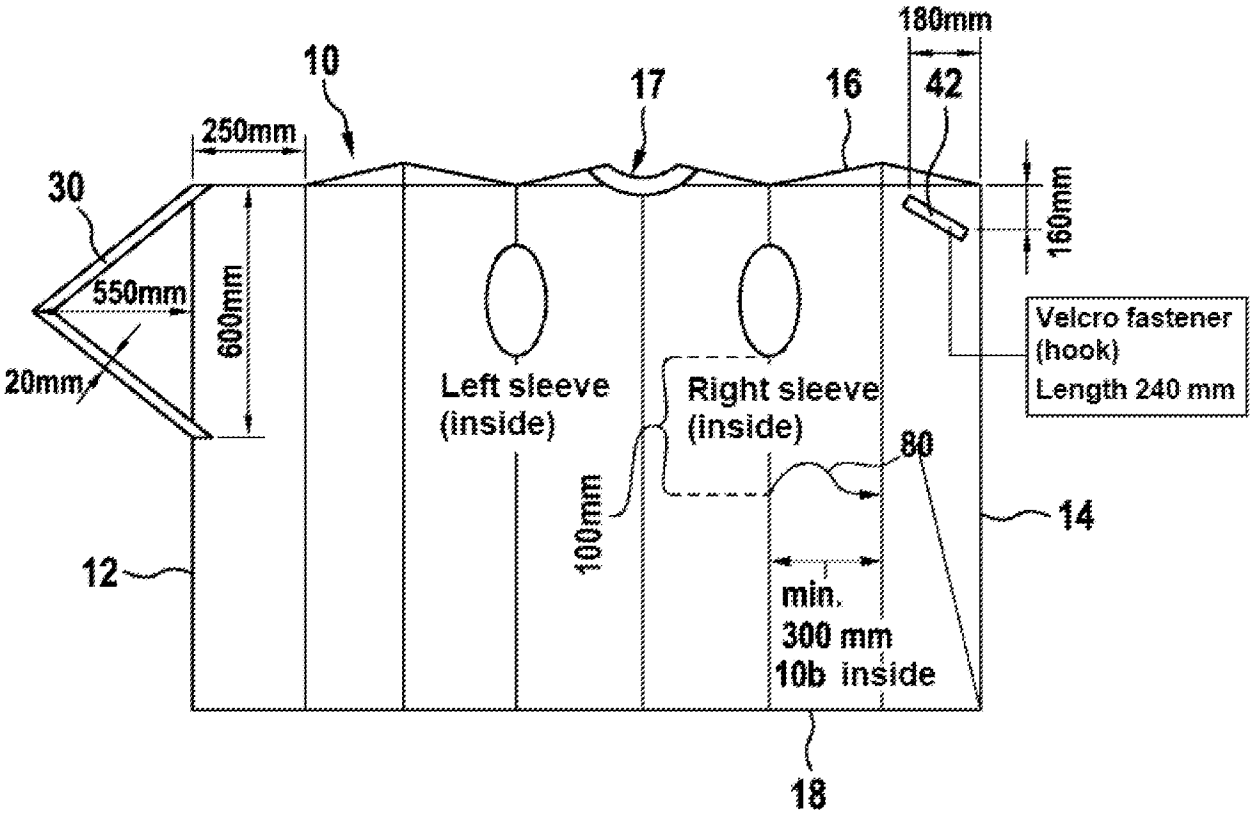

The embodiment shown in FIGS. 3 and 4 may differ from the embodiment explained with reference to FIGS. 1 and 2 in that the adhesive strips 42 and 44 each form an acute angle of approximately 60° with the adjacent lateral edges 14 and 12, respectively. In this process also, in accordance with the embodiment illustrated in FIGS. 3 and 4, the fastener strip adjacent to the lateral edge 14 is also arranged on the inside of the material web, while the adhesive strip 44 adjacent to the lateral edge 12 is arranged on the outside of the material web. In addition, an activatable fastener 52, such as a fastener that can be activated by pressure or tensile force (e.g. a snap fastener), is arranged on the outside of the material web in the area of the upper edge 16 and/or in the area of the upper end of the second lateral edge 14. The fastener 52 is designed to be releasably connected to a fastener assembly 50 and to detach from the fastener assembly 50 via activation of the fastener 52. The fastening arrangement 50 is suitable for producing a releasable fastening of the surgical gown to a suspension 100 for the surgical gown and can be provided on the material web 10 by connection to the fastening means 52. Furthermore, one, two or more longitudinal waist cords 70 provided for tying the surgical gown at waist height are provided on the surgical gown. The waist cords 70 may include a left binding tape on the second lateral edge 14 and a right binding tape for tying the surgical gown. The right binding tape can then extend from the outer surface of the surgical gown or the material web 10 and may be attached to the outer surface between the two sleeves at approximately waist height. This is illustrated by way of example in FIG. 4. The left and right binding tapes can be knotted or otherwise connected by the wearer to tie the gown after putting on the surgical gown.

To avoid damage and/or to ensure the required sterility, the surgical gown can have the tube 130 releasably attached to its left binding tape 70*a*, which is attached to the material web 10, in particular to the second edge 14, with a second fixed end and has a first (loose) end into which the left binding tape is pushed with the first end first, so that the tube surrounds at least part of the length of the left binding tape and the loose end and thereby protects it. The second end of the tube faces the fixed end of the left binding tape and the first end of the tube is loose or is used for grasping by the assistant or for releasable attachment to the suspension 100. The band 50*a* partially accommodated in the tube 130 may further comprise a second fastening means 132, which can be releasably connected to the first fastening means 52 of the surgical gown, the second fastening means 132 may be separated from the first and/or second fastening means by activating the first and/or second fastening means.

When the surgical gown is put on, the left binding tape can be released from the transfer card or knot 60 arranged on the tube, for example by simply pulling on the left binding tape 70*a*, if the left binding tape 70*a* is attached with a clamping effect or a knot on the binding tape 130 that can be released by pulling. The transfer card then remains on or falls away from the tube, while the left binding tape can be used by the wearer to close the gown.

Figure 5:
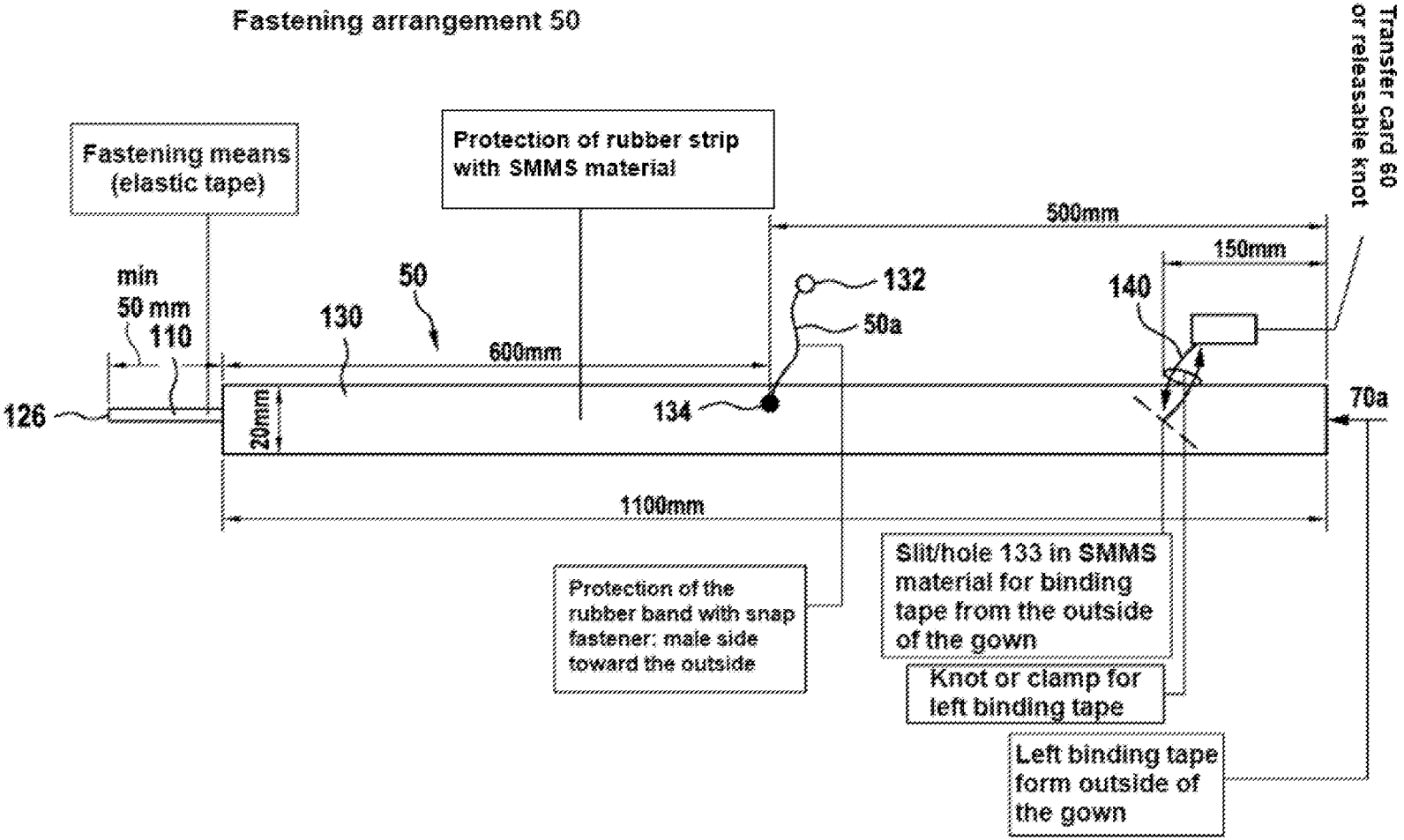

FIG. 5 shows a fastening arrangement 50 designed for releasably fastening the surgical gown to the suspension 100. The band, designated overall by 50, comprises an elastic and stretchable band 110 (such as a binding tape, e.g. a rubber band) made of elastically stretchable material with a third fastening means 126. Furthermore, the fastening arrangement 50 includes the tube 130, the elastic and stretchable band 50*a* with the second fastening means 132, and the transfer card or node 60 is arranged on the fastening arrangement 50. The bands 50*a* and 110 can, as described, be formed by one and the same elastic band 50*a*, 110, which is guided through the tube 130. The elastically stretchable band 50*a*, 110 is accommodated in a tube 130 made of spunmelt fabric [SMMS]. The tube has a slit-shaped opening 133 and an outlet opening 134. The tape 50*a*, 110 made of elastically stretchable material is equipped at its one (second) end with the second fastening means 132, such as a snap fastener element, which interacts with the first fastening means 52 on the outside of the material web 10 in the sense of a releasable connection. The fastening means 52 and 132 can be complementary, i.e. counterparts to one another. The tape 50*a*, 110 is equipped at its other (first) end with the third fastening means 126, such as a snap fastener element and/or a loop, which cooperates with the suspension 100 in the sense of a releasable connection. The suspension 100 and the third fastening means 126 can be complementary, i.e. counterparts to one another.

The left binding tape 70*a* can be knotted or clamped (for example by means of a loop on the left binding tape) to the transfer card or knot 60 in such a way that when a pulling force is exerted on it, it detaches from the transfer card and the card falls to the floor. Additionally or alternatively, the transfer card 60 can be detachably connected to the left binding tape 70*a* via a snap fastener system.

In particular, the tube 130 can have an opening 133 on a side surface, for example a slit, through which the first end of the left binding tape 70*a* can be passed in order to releasably clamp the left binding tape on the transfer card 60 (for example by means of a loop on the left binding tape), whereby the pull releases the clamping effect and particularly the transfer card falls off the tube and the left binding tape by releasing the clamping. Alternatively, instead of the transfer card, a detachable knot 60 to which the first end of the left binding tape 70*a* is knotted can be used and can be detached using the pull. In FIG. 5, the clamping (e.g. loop) or knotting of the left binding tape is marked with reference number 140.

Figure 5A:
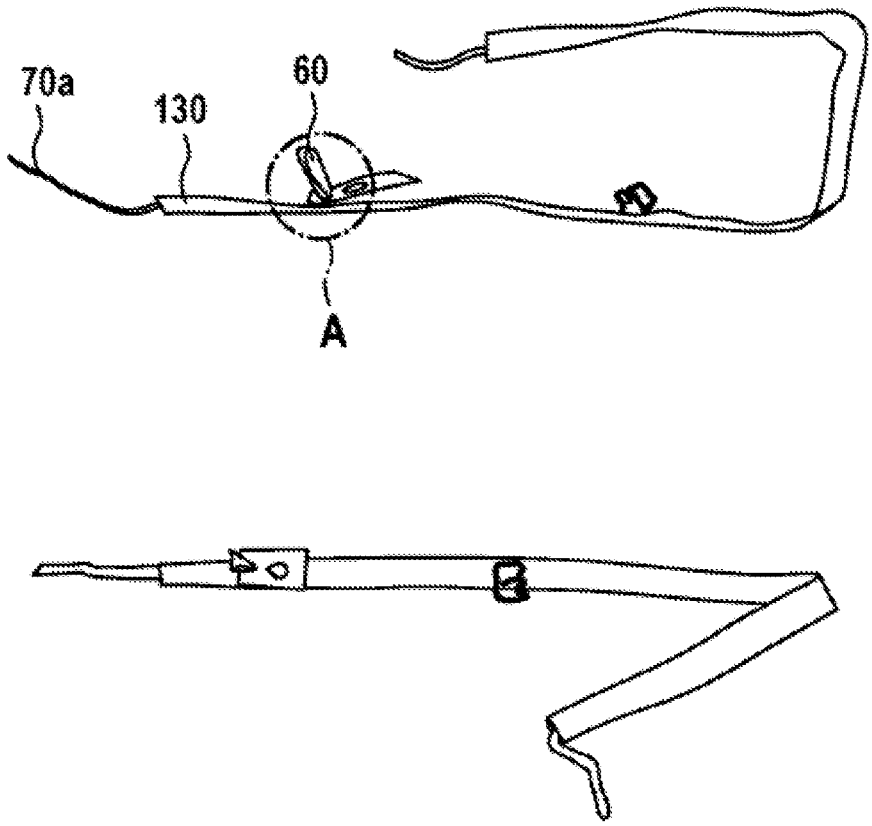

In another embodiment, a loop of the left binding tape 70*a* passes through a slot in the transfer card 60, as indicated at A in FIG. 5A, so that the loop is pulled through the slot in the transfer card by pulling on the left binding tape and thus separated from the transfer card.

When the gown connected to the suspension 100 via the connecting elements, of which the fastening means 52, 126 and 132 are shown in the drawing, is conveyed to the donning process, after the arms have been inserted into the corresponding openings 22, 24, the tape 110 and/or the tape 50*a* made of stretchable material is stretched and tensioned until the connecting elements 52, 132 separate from one another. The connection to the suspension 100 can be retained.

Embodiments claimed by the following claims are described in the description and in the figures. The optional features disclosed in the foregoing description, claims and drawings may be used both individually and in any arbitrary combination for carrying out various embodiments in accordance with the appended claims.

The invention claimed is:

1. A surgical gown comprising:

a material web bounded by:

a first lateral edge that extends in an approximately straight line;

a second lateral edge that extends approximately parallel to the first lateral edge;

an upper edge that connects the first and second lateral edges to one another; and a lower edge that connects the first and second lateral edges to one another;

a first sleeve that extends from a first opening in, and attached to, the material web;

a second sleeve that extends from a second opening in, and attached to, the material web;

a donning aid that forms an extension of the material web is arranged at least in an upper half of the first lateral edge and is adjacent to the upper edge;

a first fastening means for detachably fastening the material web to a suspension for the surgical gown, wherein the first fastening means is on an outer boundary surface of the material web that faces away from a wearer of the surgical gown when the surgical gown is being worn or the first fastening means is on a second boundary surface of the material web that faces the wearer when the surgical gown is being worn; and an inner binding tape attached to the second boundary surface;

wherein the first opening is arranged between the first lateral edge and the second opening;

wherein the first opening and the second opening are arranged closer to the upper edge than to the lower edge; and wherein the first fastening means is in a region of the upper edge or in a region of an upper end of the second lateral edge;

wherein the first fastening means is configured to be detachably connected to a fastening arrangement of the surgical gown that is for attaching the surgical gown to the suspension, wherein the first fastening means is configured so that the connection to the fastening arrangement can be detached by means of pressure, tensile force, or tearing, thereby releasing the material web from the suspension;

wherein the fastening arrangement has one or more at least partially elastic tapes configured to detachably attach the material web to the suspension;

the one or more tapes include a second fastening means;

the one or more tapes are configured to be detachably connected to the first fastening means via the second fastening means; and the second fastening means are configured to be detached by pressing or pulling the first fastening means or second fastening means; and wherein the one or more at least partially elastic tapes extend at least in sections through a tube that protects the one or more tapes, and the one or more tapes emerge from the tube through an opening at a first of two ends of the tube, and the one or more tapes further emerge through an exit point on a side surface of the tube for the material web to be detachably connected to the suspension.

2. The surgical gown of claim 1, wherein the surgical gown has a left binding tape that is attached to the material web with a fixed second end in a region of the second lateral edge, and wherein the left binding tape further has a first end;

wherein the surgical gown further has a right binding tape that is attached with a fixed end to the outer boundary surface, and wherein the right binding tape further includes a loose end; and wherein the left binding tape and the right binding tape are intended for closing the surgical gown.

3. The surgical gown of claim 2, wherein the tube also serves to protect the left binding tape, the tube is detachably attachable to the left binding tape, and wherein the left binding tape can be pushed into the tube with the first end first in such a way that the tube surrounds at least part of the left binding tape.

4. The surgical gown of claim 3, wherein the second end of the tube serves to receive the first end of the left binding tape, the tube is part of the fastening arrangement, and in the region of the first end of the tube, a third fastening means is attached to the one or more at least partially elastic tapes in a region of the first end of the tube, wherein the third fastening means is configured to detachably attach the one or more at least partially elastic tapes and the tube to the suspension.

5. The surgical gown of claim 4, wherein the second fastening means or the third fastening means includes a loop or a snap fastener.

6. The surgical gown of claim 2, wherein the left binding tape and the tube can be connected to one another by means of a transfer card arranged on the tube or by means of a releasable knot arranged on the tube such that the left binding tape is detached from the transfer card or the releasable knot and thereby also from the tube by pulling on the left binding tape.

7. The surgical gown of claim 6, wherein the tube has an opening on one side surface of the tube through which the first end of the left binding tape can be passed to clamp the left binding tape detachably to the transfer card or to tie the left binding tape to the releasable knot, and wherein the pulling on the left binding tape releases the clamping effect or the releasable knot and thereby removing the first end of the left binding tape from the opening on the one side surface of the tube and the tube, and wherein the transfer card is configured to drop from the tube and the left binding tape due to the release of the clamping effect.

8. The surgical gown of claim 6, wherein the transfer card is detachably attached to the tube.

9. The surgical gown of claim 6, wherein the left binding tape passes through a slot in the transfer card in such a way that the left binding tape, on a side facing away from an insertion side of the transfer card, forms a loop that can be pulled through the slot by pulling on the left binding tape, thereby causing the loop of the left binding tape to come apart.

10. The surgical gown of claim 1, wherein the inner binding tape is configured to be connected to the donning aid to close the surgical gown at the back of the wearer when the surgical gown is worn by the wearer.

11. The surgical gown of claim 1, wherein the suspension is attached to a wall, floor, or ceiling of a room, and wherein the suspension is configured to hold the surgical gown while the wearer of the surgical gown is putting on the surgical gown.

12. A kit comprising the surgical gown of claim 1, wherein the surgical gown is received in a package that is a peel-flap bag.

13. A surgical gown comprising:

a material web bounded by:

a first lateral edge that extends approximately in a straight line;

a second lateral edge that extends approximately parallel to the first lateral edge;

an upper edge that connects the lateral edges to one another; and a lower edge that connects the lateral edges to one another;

a first sleeve attached to the material web and extending from a first opening in the mate-rial web;

a second sleeve attached to the material web and extending from a second opening in the material web, wherein the first opening is arranged between the first lateral edge and the second opening, and wherein the first and second openings are arranged closer to the upper edge than to the lower edge;

a donning aid that forms an extension of the material web, wherein the donning aid is located in a region of an upper half of the first lateral edge adjacent to the upper edge;

a first fastening means for detachably fastening the material web to a suspension for the surgical gown, wherein the first fastening means is located on an outer boundary surface of the material web that faces away from a wearer of the surgical gown when the surgical gown is being worn, and wherein the first fastening means is located on the outer boundary surface in a region of the upper edge or in a region of an upper end of the second lateral edge; and a fastening arrangement that includes one or more at least partially elastic tapes for producing the detachable fastening of the material web to the suspension, wherein the one or more tapes include a second fastening means;

wherein the one or more tapes are adapted to be releasably connected to the first fastening means;

wherein the second fastening means is configured to be detached from the first fastening means by pushing or pulling the first fastening means or the second fastening means, or by means of tensile force or tearing at a predetermined breaking point between the first and second fastening means;

wherein the one or more tapes extend at least in sections through a tube that protects the one or more tapes, wherein the one or more tapes emerge from the tube through an opening at a first of two ends of the tube and through an exit point on a side surface of the tube to releasably connect the material web to the suspension;

wherein the surgical gown further includes a binding tape includes a first end and a second fixed end that is fastened to the material web in a region of the second lateral edge, and the tube is detachably fastened to the binding tape; and wherein the binding tape can be pushed into the tube with the first end first in such a way that the tube surrounds at least part of the length of the binding tape.

* * * * *